United States Patent [19]

Rosenfield et al.

[11] Patent Number: 4,914,422

[45] Date of Patent: Apr. 3, 1990

[54] TEMPERATURE AND MOTION SENSOR

[76] Inventors: Daniel Rosenfield, 1646 Westwind Way, McLean, Va. 22102; Michael Rosenfield, 9414 Menton Rd., Chardon, Ohio 44024

[21] Appl. No.: 407,095

[22] Filed: Sep. 14, 1989

[51] Int. Cl.[4] ..... G08B 23/00

[52] U.S. Cl. ..... 340/573; 340/586

[58] Field of Search ..... 340/573, 586; 128/782

[56] References Cited

U.S. PATENT DOCUMENTS 3,908,180 9/1975 Braginsky ..... 340/573 X
4,196,429 4/1980 Davis ..... 340/573 X
4,418,337 11/1983 Bader ..... 340/573 X
4,468,656 8/1984 Clifford et al. ..... 340/573 X

*Primary Examiner*—Joseph A. Orsino
*Assistant Examiner*—Thomas J. Mullen, Jr.
*Attorney, Agent, or Firm*—David H. Semmes

[57] ABSTRACT

A personal alert safety system (PASS) of the type carried by firefighters, rescuers, and the like. The unit attaches to the firefighters shoulder harness and is characterized by its ability to indicate audibly temperature changes in 100° F. increments within the hazardous environment, as well as lack of motion by the firefighter. The activating circuit includes a horn alarm signalling both temperature changes and lack of motion, such that both the firefighter, as well as his colleagues, may be audibly apprised.

9 Claims, 5 Drawing Sheets

TEMPERATURE AND MOTION SENSOR

BACKGROUND OF THE INVENTION

1. Field of the Invention:

Temperature and motion sensor of the type used by firefighters, rescue workers, and the like to signal audibly temperature changes, lack of motion and "distress" within the rescue environment.

2. Description of the Prior Art:

Being separately submitted.

SUMMARY OF THE INVENTION

A personal alert safety system (PASS) in the form of a temperature and motion indicator for firefighters, rescue workers, and the like. The device is worn on the firefighter's safety harness and comprises a fire-resistant housing, a highly visible on/off switch and an activating circuit, including temperature and motion sensors, as well as an audible signal horn alarm, signalling both temperature changes in 100° F. increments, as well as lack of detected motion.

DESCRIPTION OF THE DRAWINGS

FIG. 5 is and end elevation showing the housing positioned upon a safety harness, air tube or the like.

DESCRIPTION OF THE PREFERRED EMBODIMENTS

Figure 1:
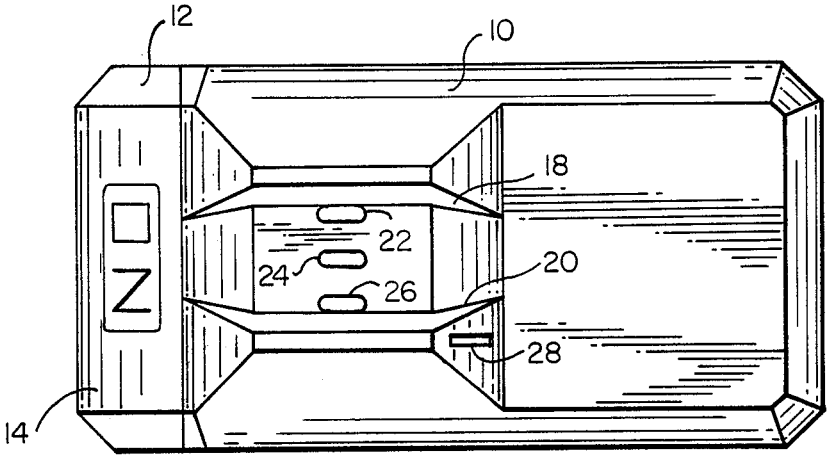
FIG. 1 is a top plan of the personal alert safety system housing, showing the on/off switch in on position.

In FIG. 1 there is illustrated in top plan a temperature and motion sensor in the form of rugged, temperature resistant, housing or case 10, including rotatable on/off switch 12, having inclined "On" surface 14. A pair of longitudinal shoulders 18, 20 extend above housing 10 so as to protect signal horn alarm apertures 22, 24, 26. Manifestly, the apertures may be variously configured and arranged. A thermocouple aperture 28 may be defined on shoulder 20, or elsewhere on the front or back of housing 10 and may include a protective cage.

Figure 2:
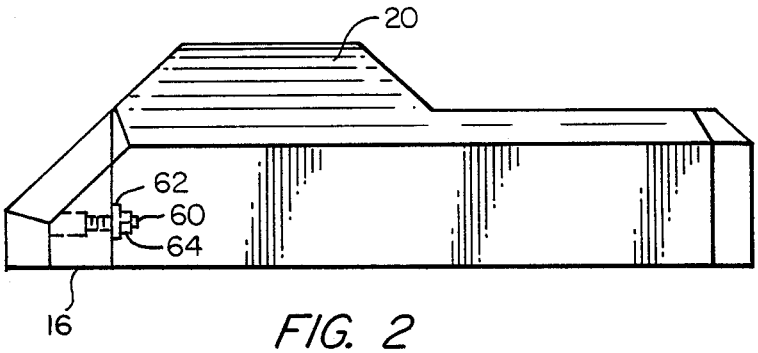
FIG. 2 is a side elevation.

As illustrated in FIG. 2, on/off switch 12 is rotatably secured to an end of housing 10 by means of longitudinally extending stud 60 which may be secured within housing 10 by washer 62 and nut 64.

Figure 4:
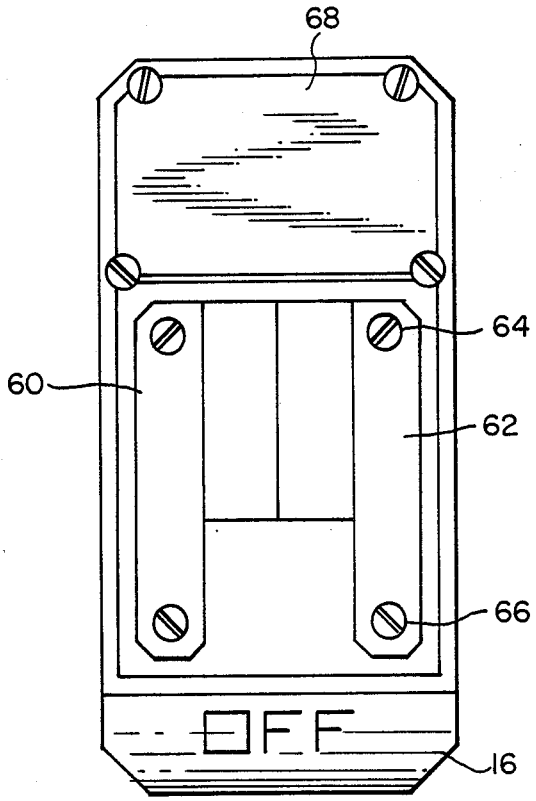
FIG. 4 is a bottom plan of the device showing the offset mounting bracket and battery compartment.
Figure 5:
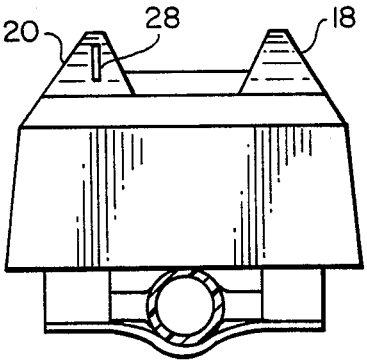

In FIGS. 4 and 5, aluminum alloy mounting brackets 60, 62 are shown as secured by means of screws 64, 66, so as to enclose without crushing an air hose or the like.

Housing 10 is composed of extremely rugged, glass filled, high-temperature plastic and has a sleek, low profile which minimizes the possibility of snagging and tangling. Housing 10 will withstand temperatures as great as 500° F. for more than an hour.

As shown in FIG. 5, brackets 60, 62 secure the device to an SCBA shoulder strap without crushing the air hose or affecting the strap, such that the device is securely positioned to avoid the firefighter's fumbling for function switch 12 in an emergency.

All functions are controlled by on/off switch 12 which is easily operated with one gloved hand. Rock and rotating de-activation procedures prevent switch 12 from accidental deactivation. The "off" side of switch 12 may be colored bright red, so as to be visible from 30 feet. The unique geometry of "on/off" surfaces 14, 16 enables the firefighter, who often is working in the dark, to determine "on/off" status of unit by feel, even with a gloved hand.

As will be apparent, temperature sensor 28 in the form of a thermocouple senses ambient temperature in 100° F. increments. Temperature is announced in audible pairs of tones, each tone representing 100° F. The tones may be grouped in pairs for easy interpretation. Thus, tones signal the temperature every sixty seconds and whenever temperature increases by 100° F. The temperature sensor operating range is 100° to 1,200° F. Temperature function does not impeded PASS emergency operation. Temperature tones are easily distinguished from PASS tones.

Signal horn alarm 56 may be activated, for example, if there is not motion for more than 35 seconds and a five second pre-alarm may warn the user that signal horn alarm 56 is about to sound. Also, signal horn alarm 56 can be activated manually by emergency or "panic" switch 36. In both cases, a unique pulsed alarm pattern aids in locating the firefighter in distress.

Figure 6:
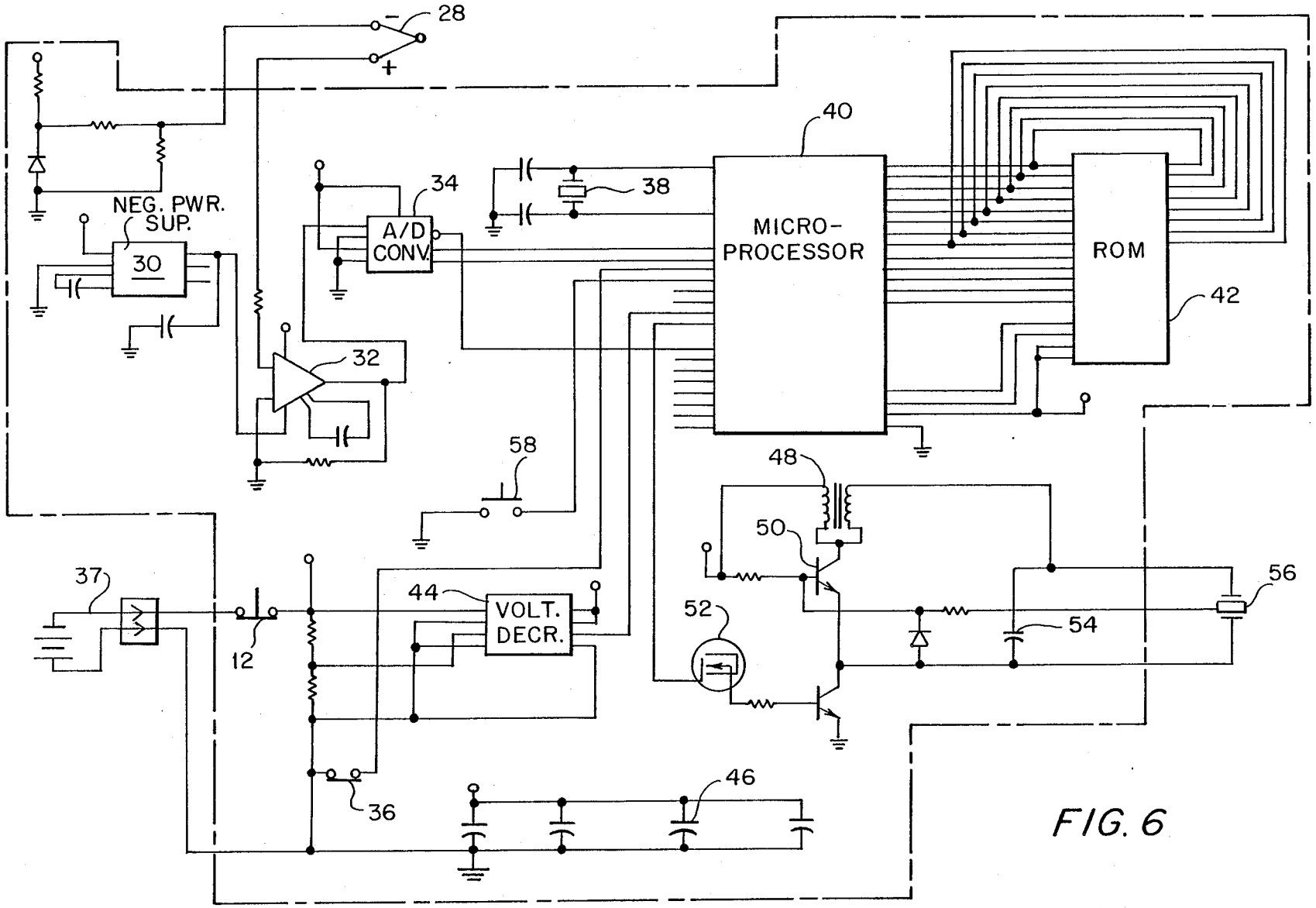
FIG. 6 is a circuit diagram of the activating circuit, including temperature and motion sensing elements, as well as signal horn.
Figure 7:
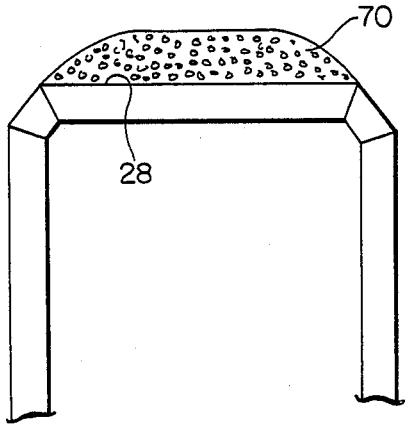
FIG. 7 is a fragmentary top plan of an end of a modified housing whereon a thermocouple temperature sensing element is positioned within a protecting cage or shield.
Figure 8:
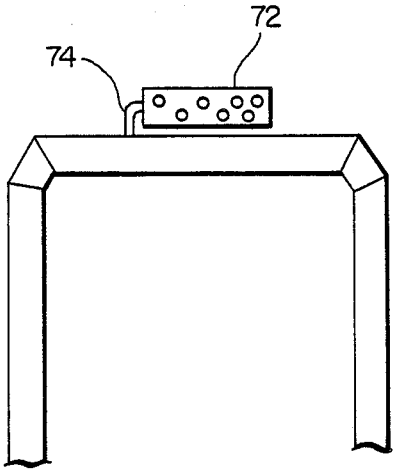
FIG. 8 is a fragmentary top plan of another modification wherein the thermocouple shield is positioned upon an offset bracket.
Figure 9:
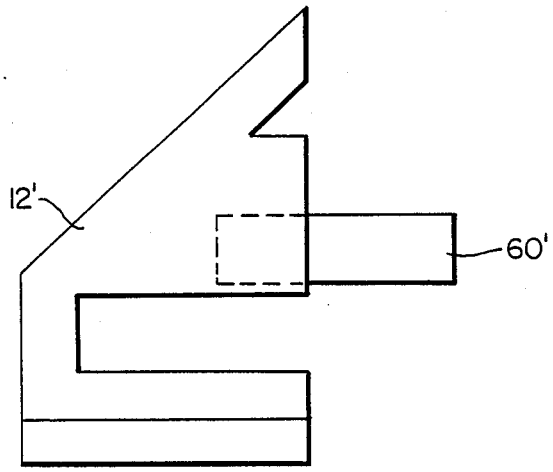
FIG. 9 is a side elevation of a modified on/off switch.
Figure 6:
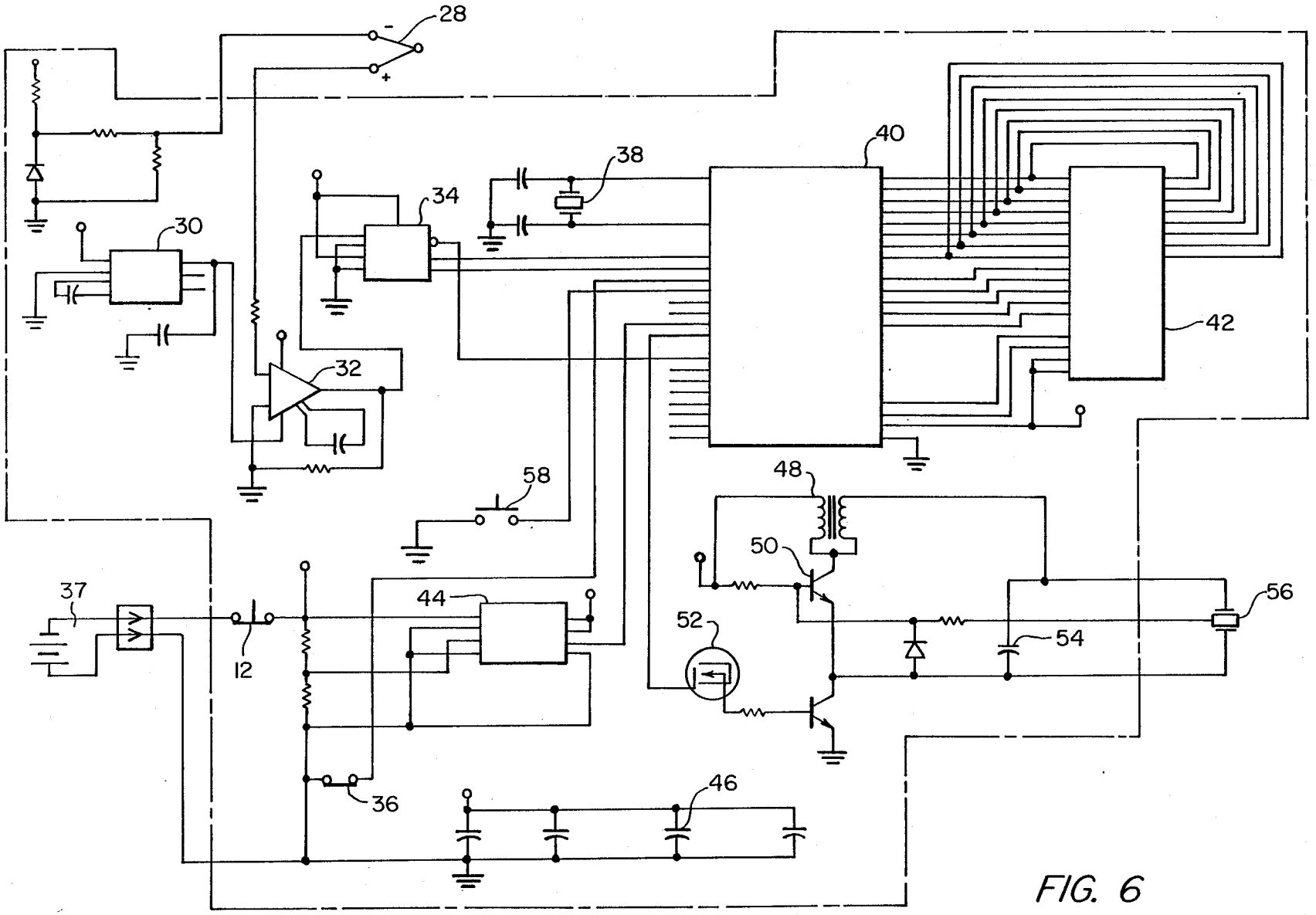

A suggested circuit for performing the temperature sensing and motion indicator functions is illustrated FIG. 6. As will be apparent, temperature sensor thermocouple 28 is positioned outside of the housing and extends to operational amplifier 32. A negative power supply 30 is operably connected, also to the amplifier. An analogue-to-digital converter 34 is positioned in between operational amplifier 32 and processor 40. The latter includes a crystal time base 38 for regulating temperature announcements and the motion detector switch in conjunction with microprocessor 40. A read only memory stores the digitized data. The circuit is powered by nine volt battery 36, controlled by on/off Reed switch 12 and voltage decrease chip 44 and filter capacitor 46. A distress or panic switch 36 operates in conjunction with processor 40 and ROM 42 to sound the distress tones.

The alarm circuit includes transformer 48, transistor 50, switching transistor 52, horn frequency capacitor 54 and signal horn 56.

As was set forth above, the temperature is signalled at 100° F. increments in pairs of distinct tones for easy interpretation. Also, crystal time base 38 insures that ambient temperature is signalled in appropriate pairs of tones every 60 seconds and whenever 100° F. temperature changes occur.

OPERATING THE PASS

Switch 12 has been designed so that ON and OFF can be determined both visually by others in the area, and by touch, even while the firefighter is wearing gloves.

1. To activate the unit, rotate switch 12 one-half turn (180 degrees) in either direction while lifting the casing 10 away from the chest, so that the switch clears the SCBA strap.

Figure 3:
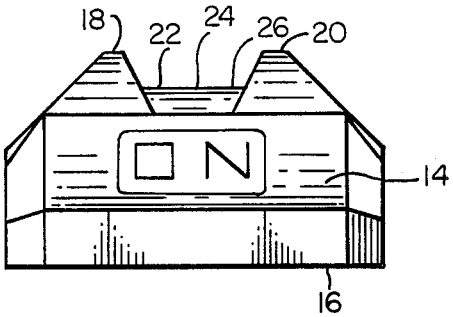
FIG. 3 is an end elevation.

When the switch is in the ON position, the green word ON is clearly visible and the curved side of the switch is facing outwards. (See FIGS. 1, 2 and 3).

2. When the unit is initially turned ON, a single beep will sound, followed by two beeps. These beeps indicate that the unit has completed an automatic self-check for satisfactory operation.

If all three of these beeps, — ——, are not heard, turn the unit off and try again. If you still do not hear all three beeps, do not use the unit.

3. To turn the unit OFF, again rotate switch 12 one-half turn (180 Degrees) in either direction while holding case away from the chest, so that switch 12 clears the SCBA strap.

Then the switch is in the OFF position, the red OFF label being clearly visible with the flat side of the switch is facing outwards.

TEMPERATURE SENSOR

The PASS device signals temperatures in 100° F. increments, from 100°-1,200° F. Each tone signals 100°. For ease in counting, tones are sounded in groups of two.

Example:

| | |
|---|---|
| - | signals 100° F. |
| -- | signals 200° F. |
| -- - | signals 300° F. |
| -- -- | signals 400° F. |

The pairs of tones are sounded as temperature signals once per 60 seconds, or whenever the temperature changes by more than 100° F.

The unit measures the temperature of the air in the immediate vicinity of the unit.

PASS ALARM:

1. The PASS alarm is automatically activated into a pre-alarm mode when the switch 12 is turned ON.

2. Thereafter, if the firefighter fails to move for thirty seconds, the unit automatically switches on a pre-alarm warning tone for five seconds. If the unit is not reset by movement within this five second period, the unit will automatically activate the PASS alarm. Manifestly, the interval and duration times of activating may be varied at will. In any case, the PASS alarm will continue to sound until manually deactivated. The PASS alarm utilizes a unique pulsed tone pattern that allows better tracking of the alarm source.

3. To reset the unit when in the pre-alarm mode, the firefighter should shrug his shoulders, walk, bend, etc., until the pre-alarm tone switches off.

4. To activate the PASS alarm, turn switch 12 to the OFF position by lifting the unit away from the chest and rotating the switch 180 degrees in either direction. The PASS alarm cannot be cancelled in any other manner.

5. The PASS alarm can be manually activated to summon aid. To operate the PASS alarm manually, rotate switch 12 approximately one-quarter turn (90 degrees) in either direction so as to activate "panic" switch 36. Signal horn alarm will then signal the pre-alarm warning tones. Do not lift the unit away from the chest to rotate the switch unless the PASS alarm is to be cancelled or turned off.

Manifestly, variations in the circuit, including both temperature and motion sensing functions, may be employed without departing from the spirit of invention and scope of the appended claims.

We claim:

1. A safety system in the form of a temperature and motion sensor comprising:

(a) a temperature resistant housing adapted for mounting on personal safety harness;

(b) an on/off switch rotatably affixed to an end of said housing; and (c) an activating circuit supported within the housing, including;

(i) a positive power supply activated by said on/off switch and a negative power supply;

(ii) a thermocouple heat sensor extending from said circuit to the exterior of said housing;

(iii) an operational amplifier interposed between said thermocouple heat sensor and said negative power supply;

(iv) an analogue-to-digital convertor adjacent said operational amplifier within said circuit;

(v) a processor of digital information, including a time base operably connected to said convertor;

(vi) a read only memory operationally connected to said processor;

(d) a signalling circuit connected to said processor and including a switching transistor and signal horn to signal temperature changes; and (e) a motion detector operationally connected to said processor so as to signal by activating said signal horn in the event of non-movement.

2. A safety system in the form of a temperature and motion sensor as in claim 1, including an emergency switch, actuated manually to signal "help required".

3. A safety system in the form of a temperature and motion sensor as in claim 1, said time base being programmed to announce temperature changes in timed intervals and pre-determined temperature increments.

4. A safety system in the form of a temperature and motion sensor as in claim 3, said signal horn including varied tone alerts including pulsed tone patterns, so as to signal temperature changes as well as "switching off" of said system and simplified tracking.

5. A safety system in the form of a temperature and motion sensor as in claim 4, said signal horn including a five second pre-alarm so as to warn the user that the signal horn is about to sound.

6. A safety system in the form of a temperature and motion sensor as in claim 1, said temperature resistant housing including a mounting bracket offset with respect to the rear of said housing so as to encircle and avoid crushing of safety harness in the form of airpack hoses or straps.

7. A safety system in the form of a temperature and motion sensor as in claim 1, said read only memory being in the form of a programmable read only memory.

8. A safety system in the form of a temperature and motion sensor as in claim 1, including a perforated shield supported upon said housing so as to encompass said thermocouple heat sensor.

9. A safety system in the form of a temperature and motion sensor as in claim 8, wherein said shield and thermocouple heat sensor are mounted upon an offset bracket extending from said housing.

* * * * *